US011014714B1

(12) United States Patent
Peters

(10) Patent No.: US 11,014,714 B1
(45) Date of Patent: May 25, 2021

(54) PRESS AND TURN FASTENER

(71) Applicant: Master Mechanologies, LLC, Concord, NH (US)

(72) Inventor: Kevin A. Peters, Concord, NH (US)

( * ) Notice: Subject to any disclaimer, the term of this patent is extended or adjusted under 35 U.S.C. 154(b) by 0 days.

(21) Appl. No.: 16/786,072

(22) Filed: Feb. 10, 2020

(51) Int. Cl.
*B65D 41/04* (2006.01)
*B65D 41/28* (2006.01)

(52) U.S. Cl.
CPC ..... *B65D 41/0471* (2013.01); *B65D 41/28* (2013.01)

(58) Field of Classification Search
CPC ..... B65D 41/0471; B65D 41/28
USPC ..... 215/330–332
See application file for complete search history.

(56) References Cited

U.S. PATENT DOCUMENTS

| | | | | |
|---|---|---|---|---|
| 1,563,112 | A | 11/1925 | Slate | |
| 3,511,403 | A * | 5/1970 | Braun | B65D 41/0471 215/330 |
| 3,620,400 | A * | 11/1971 | Braun | B65D 41/0471 215/330 |
| 4,456,137 | A * | 6/1984 | Lyman | B65D 41/0471 215/230 |
| 4,643,330 | A * | 2/1987 | Kennedy | B65D 41/04 215/329 |
| 4,948,001 | A | 8/1990 | Magly | |
| 5,135,124 | A * | 8/1992 | Wobser | B65D 41/0471 215/222 |
| 5,549,224 | A | 8/1996 | Wu et al. | |
| 7,331,479 | B2 | 2/2008 | Oh | |
| 7,721,391 | B2 | 5/2010 | Bukovitz et al. | |
| 7,802,692 | B2 * | 9/2010 | Maejima | B65D 41/0471 220/293 |
| 7,942,287 | B2 | 5/2011 | King | |
| 2017/0073121 | A1 * | 3/2017 | Tanaka | B65D 41/0471 |

FOREIGN PATENT DOCUMENTS

| | | | | |
|---|---|---|---|---|
| DE | 202012100969 U1 * | 5/2012 | | B65D 41/06 |
| DE | 102018218552 A1 * | 4/2020 | | B65D 41/3447 |
| JP | 2010023908 A * | 2/2010 | | |
| WO | 92/16034 A1 | 9/1992 | | |

OTHER PUBLICATIONS

Wikipedia, "Screw Thread", accessed at least as early as Nov. 18, 2019.

* cited by examiner

*Primary Examiner* — James N Smalley
(74) *Attorney, Agent, or Firm* — Patent Negotiator, PLLC; Sarita Pickett

(57) ABSTRACT

The system and method for a press and turn fastener having a plurality of mated thread sets where their symmetrical configuration is used in a fastening application to attach a male and female component. It is understood that this press and turn fastening system is useful for several applications including, but not limited to, pressurized and non-pressurized containers; mechanical, and electrical connections (e.g., light bulbs). The press and turn fastener requires only a fraction of a turn to be secured. In some cases, the press and turn faster also includes at least one locking feature, at least one stop, or both.

16 Claims, 10 Drawing Sheets

PRESS AND TURN FASTENER

FIELD OF THE DISCLOSURE

The present disclosure relates to fastener technology and more particularly to a press and turn fastener capable of fastening after less than a half rotation.

BACKGROUND OF THE DISCLOSURE

Traditional bottle caps/tops have spiral (helix) threads. This style of threads can make it difficult to engage both cap and top when re-attaching, and can even lead to cross-threading when doing so. Additionally, those spiraling, helix threads for bottle caps/tops can require several turns before the cap is finally closed on the bottle top which is tedious. Furthermore, at times, considerable turning effort, as well as several turns, is required with conventional bottle caps/tops before the cap is securely fastened. Wherefore it is an object of the present disclosure to overcome the above-mentioned shortcomings and drawbacks associated with the conventional fasteners.

SUMMARY OF THE DISCLOSURE

One aspect of the present disclosure is a press and turn fastener, comprising: a female portion having an internal boundary and at least one female thread set; and a male portion having an external boundary configured to mate with the female internal boundary and at least one male thread set, wherein when the at least one female thread set is rotated a fraction of a turn it mates with the at least one male thread set to create at least one mated thread set.

One embodiment of the press and turn fastener is wherein the fraction of a turn is less than 45°. In some cases, the fraction of a turn is greater than 30°. In certain cases, the fraction of a turn is about 90°.

Another embodiment of the press and turn fastener is wherein the at least one mated thread set comprises a total of two or more threads. In some cases, the fastener comprises two or more mated thread sets.

Yet another embodiment of the press and turn fastener further comprises at least one stop. In some cases, the stop may be rounded on a first end. In certain embodiments, the press and turn fastener further comprises a locking feature.

In some cases, the press and turn fastener further comprises a thread incline angle $\delta$ for the mated thread set. In certain embodiments, the thread incline angle prevents back threading. When two halves of a mated thread set are rotated clockwise to fasten, the leading edges of each half of a mated thread set can be rounded to facilitate mating and fastening. When two halves of a mated thread set are rotated clockwise to fasten, the trailing edges, each half of a mated thread set, can be blunted to prevent back threading and to provide greater surface area to contact for sliding and removal from slots. In some cases, any outer most threads of a mating thread set can have a varied width and a point of inflection where a leading bevel ends. In certain embodiments of the press and turn fastener, the extent of the bevel is represented by the angle $\alpha$ and/or angle $\beta$.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1A:
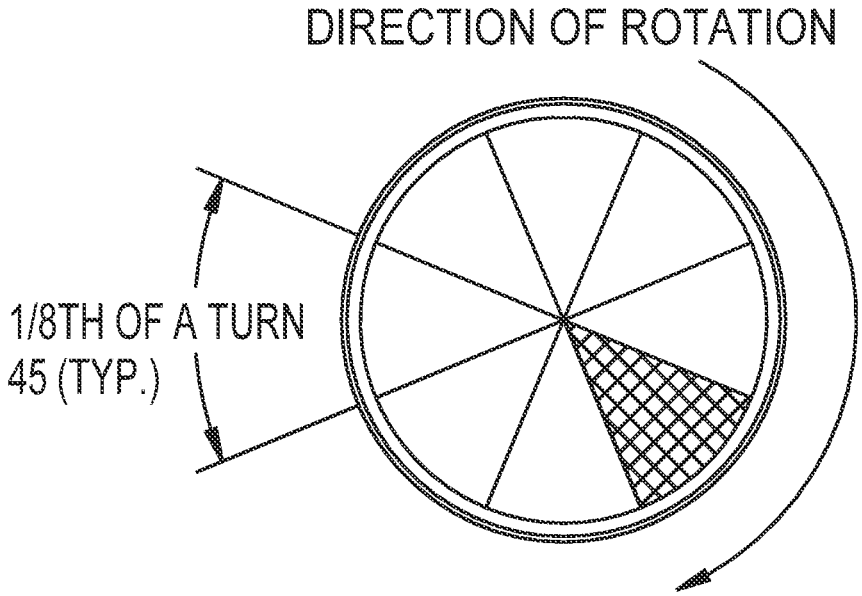
FIG. 1A is a top view of one embodiment of a female portion of a press and turn fastener in a first position according to the principles of the present disclosure.

In one embodiment of the press and turn fastener of the present disclosure, there is a set of arrayed thread stacks with an equal amount of arrayed slot openings (alternating between each other: threads, slot, threads, slot, etc.) in a bottle cap and on a bottle top. In some cases, on the bottom of each stack of threads in the bottle cap is an angled-beveled thread. Likewise, on the top of each stack of threads on the bottle top is a similar angled-beveled thread. When mating the bottle cap to the bottle top, these angled-beveled threads (on the bottom of bottle cap thread stacks and on the top of bottle top thread stacks), make contact with each other and facilitate the thread stacks finding their way into the slots. This is in contrast to the difficulty that can be experienced when attaching a traditional bottle cap/top that has spiral (helix) threads.

The press and turn fastener of the present disclosure provides for easy mating of a bottle top and a bottle cap, for example, as compared to traditional spiral (helix) type of bottle cap/top. In certain embodiments, the fastener has a "quick-close" feature, e.g., one short rotation will secure the male and female components of the fastener. In one case, the bottle cap is the female component and the bottle top is the male component.

In one particular embodiment, a 45° turn, or a turn of a $\frac{1}{8}^{th}$ of a circle is all that is needed to secure the fastener. This is a very useful advantage in fastener technology: Easy mating of male and female components, and one short turn to secure the fastener. In some cases, because the stacked threads of the fastener are aligned at the same angle, they offer considerable clamping force at each point where they are located around the perimeter of the male and female components. In certain embodiments there are only two sets of mated threads on opposing sides of a circle.

In certain embodiments, a "stop" is located at the bottom of each slot on the male component (bottle top). In some cases, the stop carefully positions the bottom-angled-beveled thread on the bottle cap (and stacked threads above it) to slide in and engage the set of stacked threads on the bottle top. So, the bottle cap threads are easily inserted into the slots on the bottle top, slide down and bottom out against the stop on the bottle top. Then, with a quick clockwise rotation both threads from the bottle cap and the bottle top are securely engaged, i.e., tightened.

It should be noted that the amount of mated thread sets and slots typically depends on the diameter of the fastener. For a large diameter, there could be as many as 12 angles (six mated thread sets and six slots), for a rotation of about 30 degrees. For a small diameter there could be four angles (two mated thread sets and two slots), for a rotation of about 90 degrees. In some embodiments, depending on the amount of clamping force required, there might only be one thread pair in the mated thread set. For greater clamping force there could be two or more pairs of threads in the mated thread set.

One embodiment of the present disclosure is a form of threads and their symmetrical configuration used in a fastening application to attach a male and female component. One embodiment shown is a bottle cap. It is understood that this press and turn fastening system is useful for several applications including, but not limited to, pressurized and non-pressurized containers; and mechanical and electrical connections (e.g., light bulbs).

It is to be understood that the press and turn fastener can also have a reverse thread, i.e., a counterclockwise rotation to fasten. This would be most evident in a mechanical fastener application. The principles of the design for the press and turn fastener would be the same except that the features would be "mirrored." And, the fastening would be similar except that the turning would be in the opposite direction.

Referring to FIG. 1A, a top view of one embodiment of a female portion of a press and turn fastener in a first position according to the principles of the present disclosure is shown. More specifically, in this embodiment the female portion is a cap for a container and a ⅛ turn or a clockwise rotation of 45° is all that it needed to secure the fastener to a mated male portion (here a container). In FIG. 1A the direction of rotation is shown and the cross-hatched area represents the threads depicted in FIG. 1B. For simplicity, only one set of mated threads comprised of threads on the female and the male portions are shown and the male and female portion are transparent in order to be able to show the threads mating. In one embodiment there are four mated thread sets symmetrically distributed about the periphery of the opening in the container and matched to the cap.

Figure 1B:
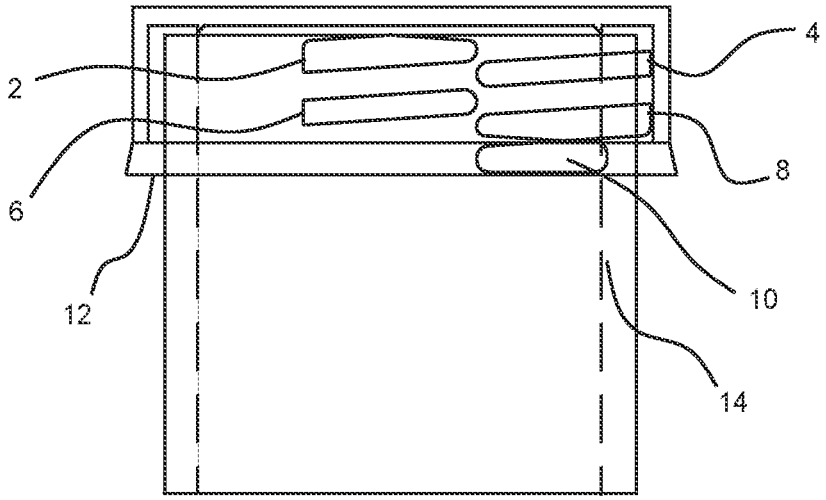
FIG. 1B is a side view of one embodiment of a female portion and a mating male portion of a press and turn fastener in a first position according to the principles of the present disclosure.

Referring to FIG. 1B, a side view of one embodiment of a female portion and a mating male portion of a press and turn fastener in a first position according to the principles of the present disclosure is shown. More specifically, in one embodiment a female portion (e.g., a cap) comprises a second thread 4 and a fourth thread 8 and the male portion (e.g., a container) comprises a first thread 2, a third thread 6 and a stop 10. A set of mated threads, as used herein, represents the smallest indivisible grouping of mated threads dispersed about a boundary between a mated male and female portion. In this embodiment, a set of mated threads includes threads 2, 4, 6, and 8. These are not engaged with each other in this orientation and the stop 10 is stacked with the second 4 and fourth 8 threads when viewed from this angle. This position represents when the male and female portions are brought into initial contact.

Figure 1C:
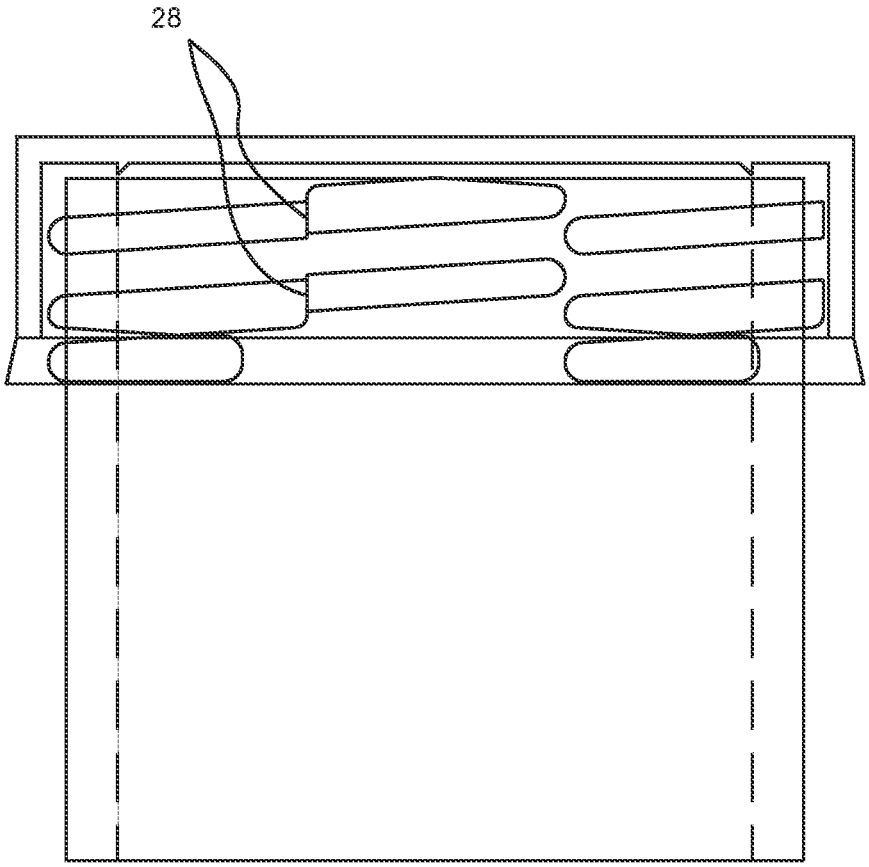
FIG. 1C is a side view of one embodiment of a female portion and a mating male portion of a press and turn fastener in a first position according to the principles of the present disclosure.

Referring to FIG. 1C, a side view of one embodiment of a female portion and a mating male portion of a press and turn fastener in a first position according to the principles of the present disclosure is shown. More specifically, in certain embodiments the bluntness of certain threads and the particular thread incline angles used for a thread prevent the mated thread sets between male and female portions from backing out (un-turning) and subsequently the male or female threads getting stuck in another set of threads when someone is trying to un-fasten the fastener. In other words, the thread sets are blocked 28 from engaging when turned in a counterclockwise direction. This also allows more surface area to contact when sliding a cap out of a bottle top while disinserting, thus acting as a guide rail.

Figure 2A:
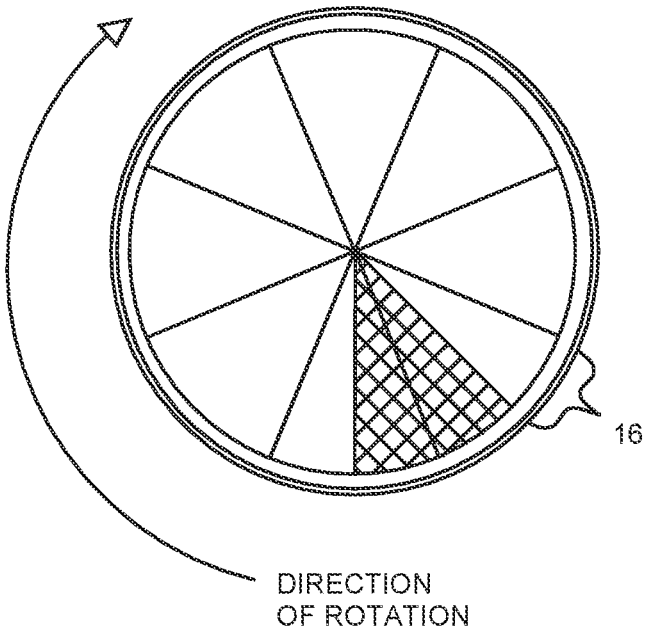
FIG. 2A is a top view of one embodiment of a female portion of a press and turn fastener in a second position according to the principles of the present disclosure.

Referring to FIG. 2A, a top view of one embodiment of a female portion of a press and turn fastener in a second position according to the principles of the present disclosure is shown. More specifically, in this embodiment the female portion is a cap for a container and a ⅛ turn or a rotation of 45° is all that it needed to fully secure the fastener to a mated male portion (here a container). In FIG. 2A the direction of rotation is shown and the cross-hatched area represents the threads depicted in FIG. 2B. For simplicity, only one set of mated threads on the female portion 12 and male 14 portion is shown and the male and female portion are transparent in order to be able to show the threads mating. In one embodiment there are four mated thread sets distributed about the periphery of the opening of the container and matched to the cap.

Figure 2B:
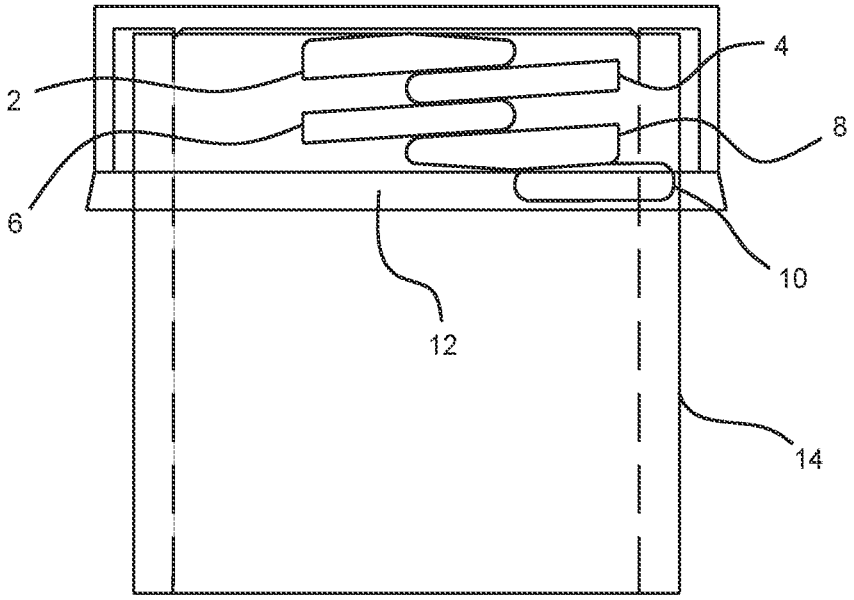
FIG. 2B is a side view of one embodiment of a female portion and a mating male portion of a press and turn fastener in a second position according to the principles of the present disclosure.

Referring to FIG. 2B, a side view of one embodiment of a female portion and a mating male portion of a press and turn fastener in a second position according to the principles of the present disclosure is shown. More specifically, the set of mating threads are engaged by 22.5° (16). As will be discussed in greater detail below, it is possible to see that the leading edges (in the direction of rotation) of the second 4 and fourth 8 threads (on the female portion) are rounded and the trailing edges (in the direction of rotation) of the second 4 and fourth 8 threads (on the female portion) are blunt. It is also possible to see that the leading edges (in the direction facing the second and fourth threads during engagement) of the first 2 and third 6 threads (on the male portion) are rounded and the trailing edges (in the direction facing the second and fourth threads during engagement) of the first 2 and third 6 threads (on the male portion) are blunt.

In certain embodiments, the blunt ends of the threads allow for easy sliding of threads in and out of slots by proving increased contact between the ends of the thread surface. Rounded or pointed edges on both ends of the threads could allow for "rattling" of threads or "chattering" action when attempting to find the proper initial position when beginning to tighten the fastener.

Still referring to FIG. 2B, the female portion is rotated onto the male portion to secure the female portion and as it is rotated it moves down farther onto the male portion as seen in the area of the stop 10 with the pictured male and female portions. The outermost threads, here the first 2 and the fourth 8 threads, can be seen having a varied thickness from their leading to trailing ends (threads are beveled/tapered—have an inflection point). These rounded portions coupled with thinner regions allow for the threads to "slide" into position for insertion into slots to provide for a press and turn fastener only a fraction of a turn to be fully engaged/secured. That is to say, when the bottle cap is positioned over the bottle top for attachment, inflection points juxtapositioned (the lower threads 8 on bottle cap, the top threads 2 on bottle top), and with a slight back-and-forth downward motion, allows for threads on bottle cap to find their way into slots on bottle top. Simultaneously, the threads on the bottle top are inserted into the slots on the bottle cap. And with one quick turn, after threads 8 seat themselves on stops 10, the bottle cap is tightened onto the bottle top. In contrast, the inner most threads, here the second 4 and third 6 threads, have a consistent thickness from their leading to trailing ends. In certain embodiments, the stop is angled only on a leading end (see, e.g., FIG. 8 and FIG. 9).

In certain embodiments the leading end is shown angled in stop 10. In the orientation shown in FIG. 2B, bottom beveled thread 8 first makes contact with the flat on stop 10. Then, female portion 12 is rotating clockwise with respect to male portion 14, and threads 4 and 8 (on bottle cap) slope down in alignment with threads 2 and 6 (on bottle top) engaging at the same angle, becoming interlocked.

Figure 3A:
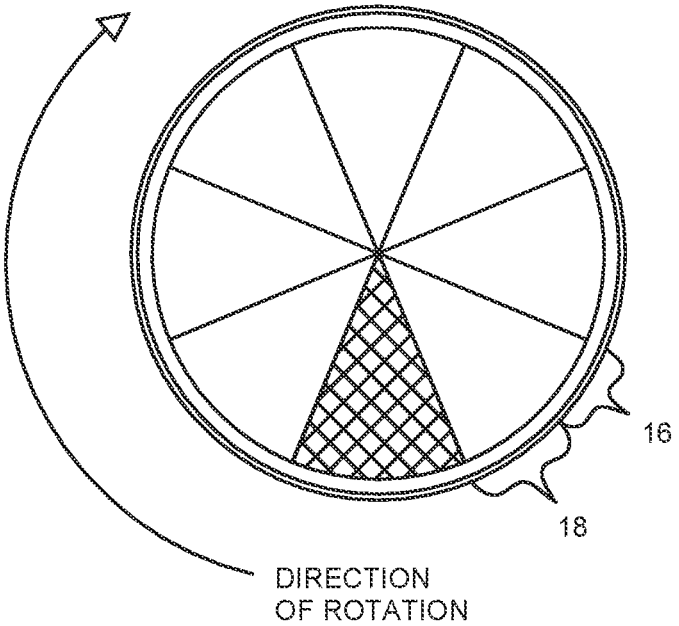
FIG. 3A is a top view of one embodiment of a female portion of a press and turn fastener in a third position according to the principles of the present disclosure.
Figure 3B:
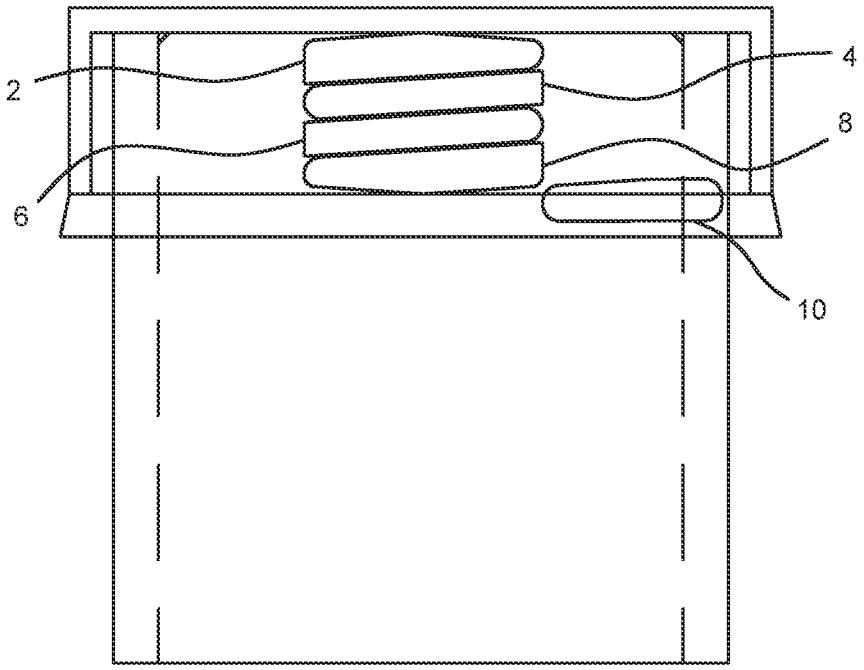
FIG. 3B is a side view of one embodiment of a female portion and a mating male portion of a press and turn fastener in a third position according to the principles of the present disclosure.

Referring to FIG. 3A, a top view of one embodiment of a female portion of a press and turn fastener in a third position according to the principles of the present disclosure is shown. More specifically, the cross hatched area has moved 45° from that shown in FIG. 1A and 22.5° (18) from that shown in FIG. 2A. FIG. 3B is a side view of one embodiment of a female portion and a mating male portion of a press and turn fastener in a third position according to the principles of the present disclosure. More specifically, in the fastened position the first 2, second 4, third 6, and fourth 8 threads are stacked and fully engaged. The stop 10 is offset from the mated thread set. From this orientation it is evident that the threads each meet at a certain thread incline angle (seen in more detail in FIG. 9). From a side view, it can be seen that the threads in the bottle cap and the bottle top are designed to be interlocking, i.e., they are spaced on the bottle cap and the bottle top, so that when the bottle cap, for example, is rotated clockwise, these threads engage and interlock (the threads on the bottle top shall be ordered first and third; the threads on the bottle cap second and fourth). Therefore, the order of threads after engaged and interlocked would be first 2 second 4, third 6, and fourth 8. When the fourth thread 8 makes contact with the positioner/stop 10, bottle cap movement downward is stopped. Bottle cap fourth thread 8 is now positioned to slide down the sloping side of positioner/stop 10 as the second 4 and fourth 8 bottle cap threads engage and interlock with the first 2 and third 6 threads on the bottle top as the bottle cap is rotated clockwise, here about 45°.

Figure 4:
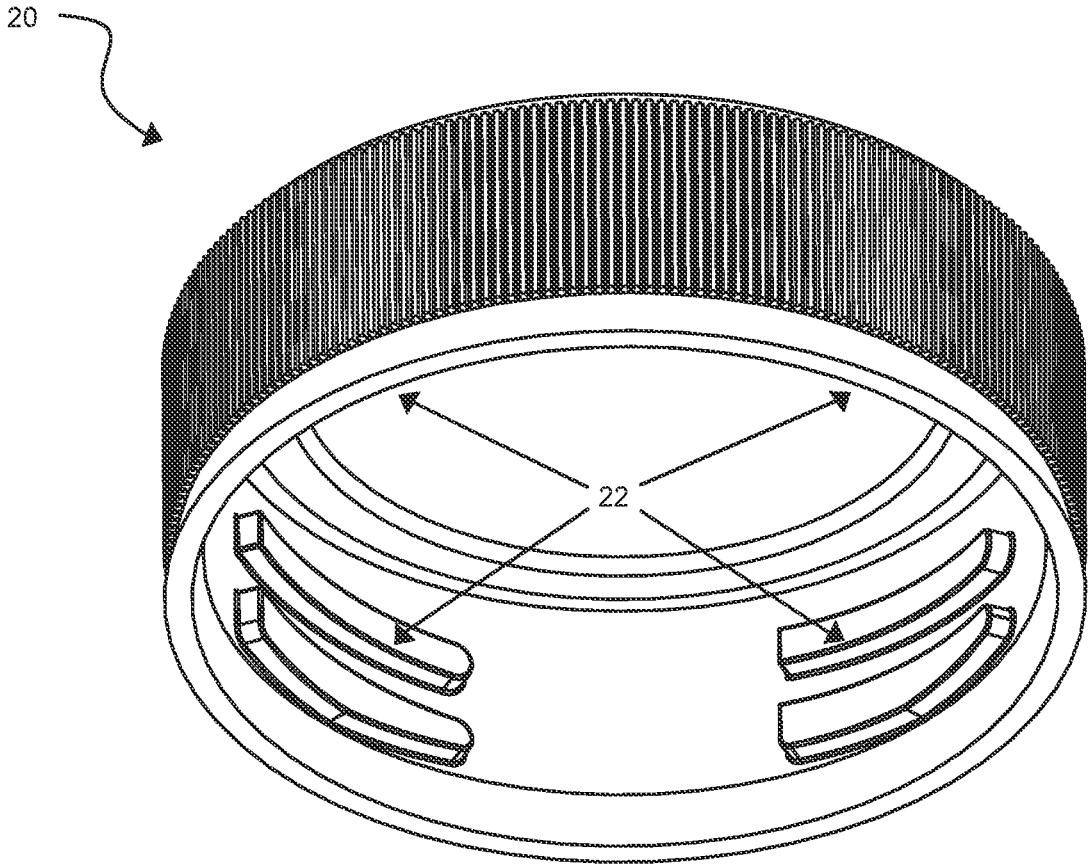
FIG. 4 is a bottom perspective view of one embodiment of a female portion for a press and turn fastener according to the principles of the present disclosure.

Referring to FIG. 4, a bottom perspective view of one embodiment of a female portion for a press and turn fastener according to the principles of the present disclosure is shown. More specifically, a female portion 20 of a press and turn fastener system is shown having four female thread sets 22 distributed symmetrically about the inner boundary of the female portion and configured to mate with four male thread sets distributed about an outer boundary of a male portion (not shown in this FIG., but see, for example, FIG. 6). From a side view, when the cap is positioned on top of the bottle top, the first thread 2, e.g., the slightly pointed extrusions with downward sloping sides on the bottle top, and the fourth thread 8, e.g., the slightly pointed extrusions with upward sloping sides on the bottle cap, allow for the threads in the bottle cap, with a slight back-and-forth rotation, to slide into the "slots" in the bottle top 36 (See, FIG. 6). There may also be a positioner/stop at the bottom of the open "slots" on the bottle top (see, 34 in FIG. 6).

Figure 5:
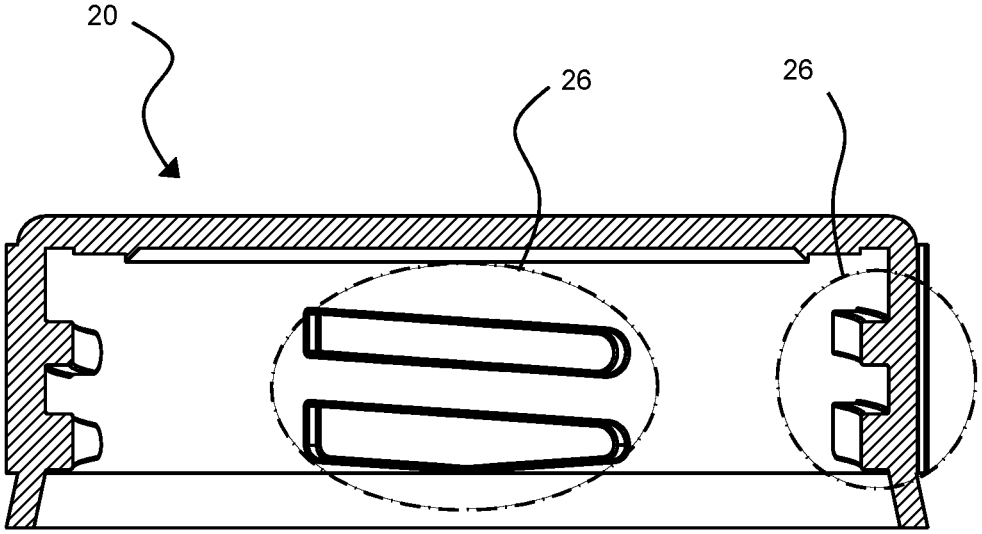
FIG. 5 is a side cross-sectional view of one embodiment of a female portion for a press and turn fastener according to the principles of the present disclosure.
Figure 5A:
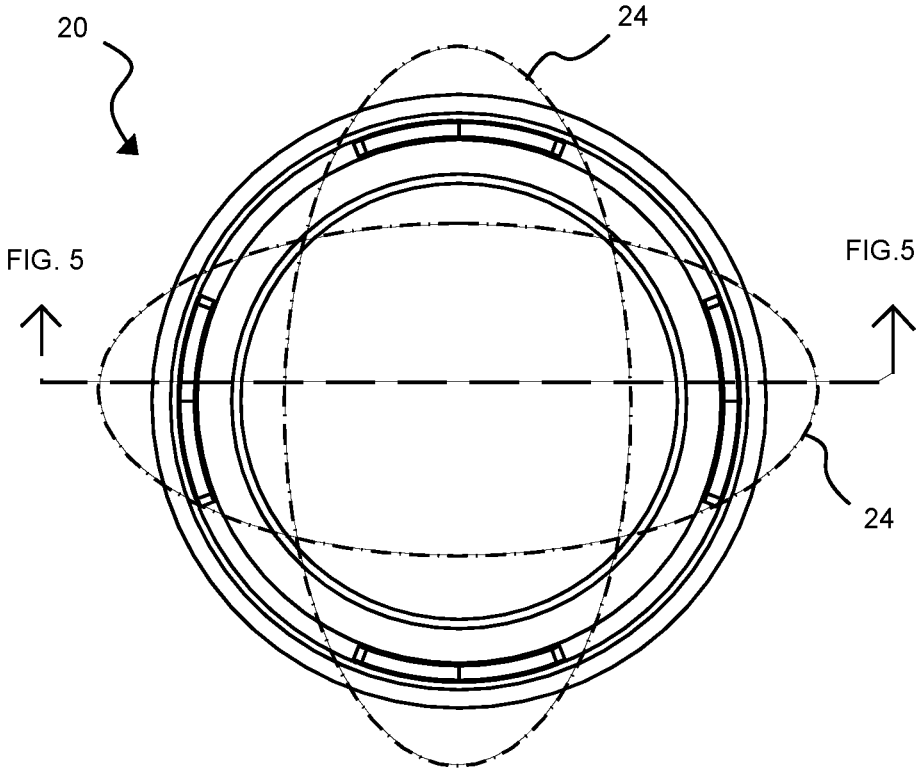
FIG. 5A is a bottom view of the embodiment of FIG. 5 and FIG. 4, showing the viewing direction of the cross-sectional view of FIG. 5.

Referring to FIGS. 5 and 5A, views of one embodiment of a female portion for a press and turn fastener according to the principles of the present disclosure are shown. More specifically, the orientation of FIG. 5 is shown in cross-section so that female thread sets 22 on opposing sides 24 (in this embodiment there are four thread sets 22) can be shown as having slight thread incline angles with respect to each other. On the far sides of the female portion in this figure, partial female thread sets 26 can be seen in this orientation. According to the previous figures, each of these female thread sets represents the second and fourth threads in a double layer stack.

It is to be understood that the total number of mated thread sets varies depending on the size of the fastener and the particular application. It is envisioned that the smallest number would be two mated thread sets on opposite sides of a fastener, so that there would be a balance to the force needed to tighten the fastener. In some embodiments several (e.g., more than four mated there sets) could be used, particularly as the fastener increases in size.

Figure 6:
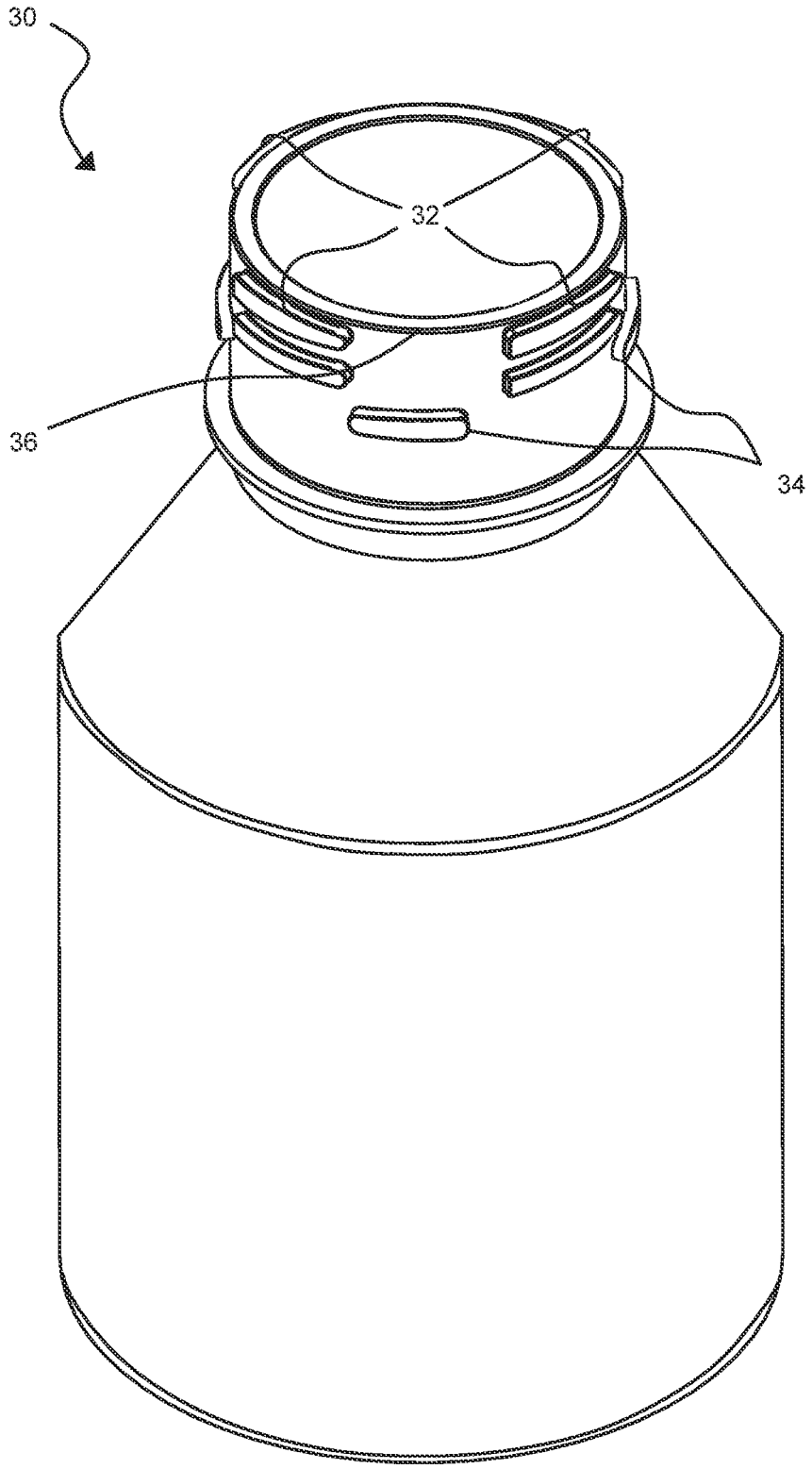
FIG. 6 is a side view of one embodiment of a mating male portion for a press and turn fastener according to the principles of the present disclosure.

Referring to FIG. 6, a side view of one embodiment of a mating male portion for a press and turn fastener according to the principles of the present disclosure is shown. More specifically, a male portion (e.g., a container) is shown and according to the previous figures, each of the male thread sets 32 would represent the first and third threads in a double layer stack. Two of the four stops 34 are also shown along with one of the slots 36.

Figure 7:
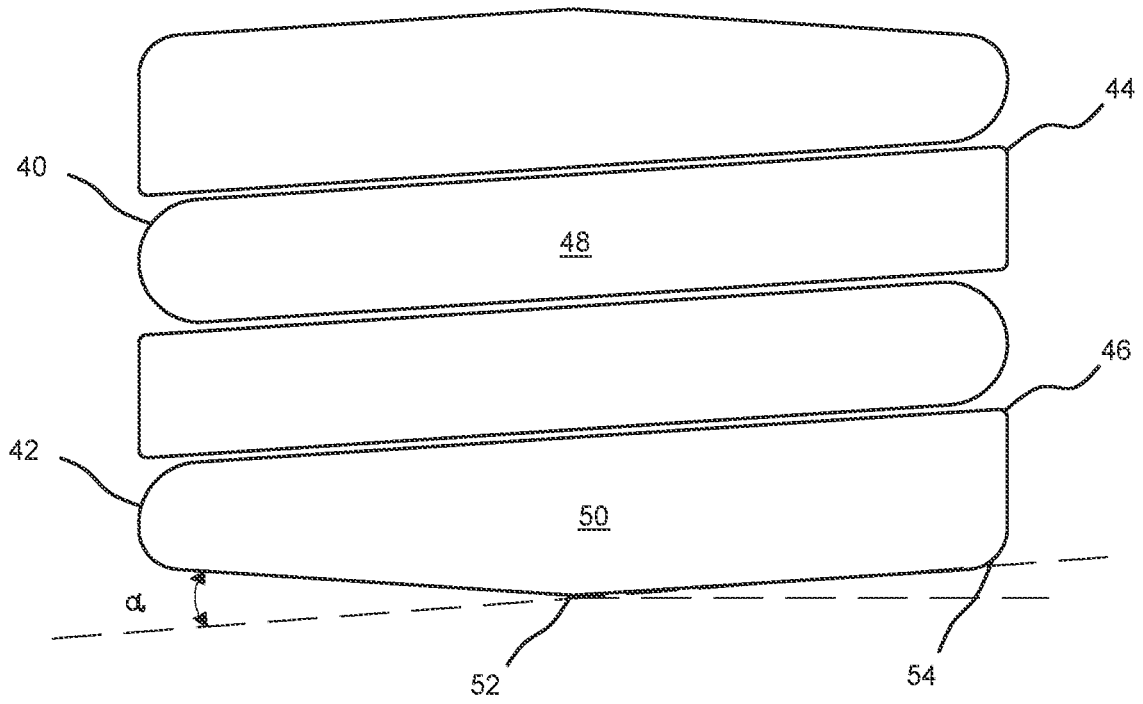
FIG. 7 is a diagrammatic view of one embodiment of one half of a mated thread set according to the principles of the present disclosure.

Referring to FIG. 7, a diagrammatic view of one embodiment of one half of a mated thread set according to the principles of the present disclosure is shown. More specifically, a second half of a mated thread set (also shown in FIG. 8) is shown in phantom for discussion purposes. When the two halves that comprise a mated set of threads are rotated clockwise to fasten, the leading edges 40, 42 of the threads 48, 50 are rounded to facilitate mating and fastening. In contrast, the trailing edges 44, 46 of the threads 48, 50 are blunted to prevent back threading. Additionally, as shown in FIG. 1C, the thread incline angles for the threads 48, 50 are such that back threading is prevented. This also allows for ease of removal of threads when unscrewing because the wider, flat surfaces of threads 48, 50 and 60, 62 act as slide rails for these thread ends to glide out of slots when making contact with each other after unscrewing, i.e., rotating bottle cap counterclockwise and then pulling bottle cap threads out of bottle top slots. The outer most thread 50 of the half of a mating thread set has a varied width and a point of inflection 52 where a leading bevel ends. The extent of the bevel is represented by the angle α. The outer side of the trailing end of the outermost thread 54 may also be rounded.

Figure 8:
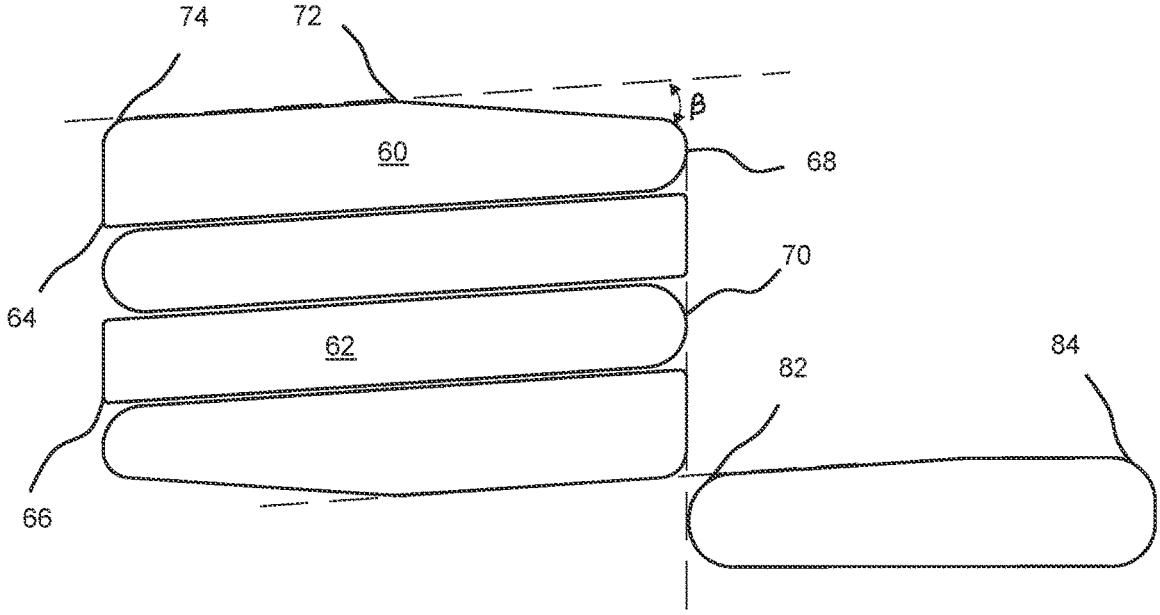
FIG. 8 is a diagrammatic view of one embodiment of another half of a mated thread set as shown in FIG. 7 and a stop according to the principles of the present disclosure.

Referring to FIG. 8, a diagrammatic view of one embodiment of another half of a mated thread set as shown in FIG. 7 and a stop according to the principles of the present disclosure is shown. More specifically, a first half of a mated thread set (also shown in FIG. 7) is shown in phantom for discussion purposes. When the two halves that comprise a mated set of threads are rotated clockwise to fasten, the leading edges 68, 70 of the threads 60, 62 are rounded to facilitate mating and fastening. In contrast, the trailing edges 64, 66 of the threads 60, 62 are blunted to prevent back threading and to allow increased surface area for sliding while disinserting bottle cap threads from bottle top threads. Additionally, as shown in FIG. 1C, the thread incline angles for the threads 60, 62 are such that back threading is prevented. The outer most thread 60 of the half a mating thread set has a varied width and a point of inflection 72 where a leading bevel ends. The extent of the bevel is represented by the angle (3. The outer side of the trailing end of the outermost thread 74 may also be rounded. A stop 80 may also be present. In certain embodiments, the stop may be rounded on a first end 82 and/or a second end 84.

Figure 9:
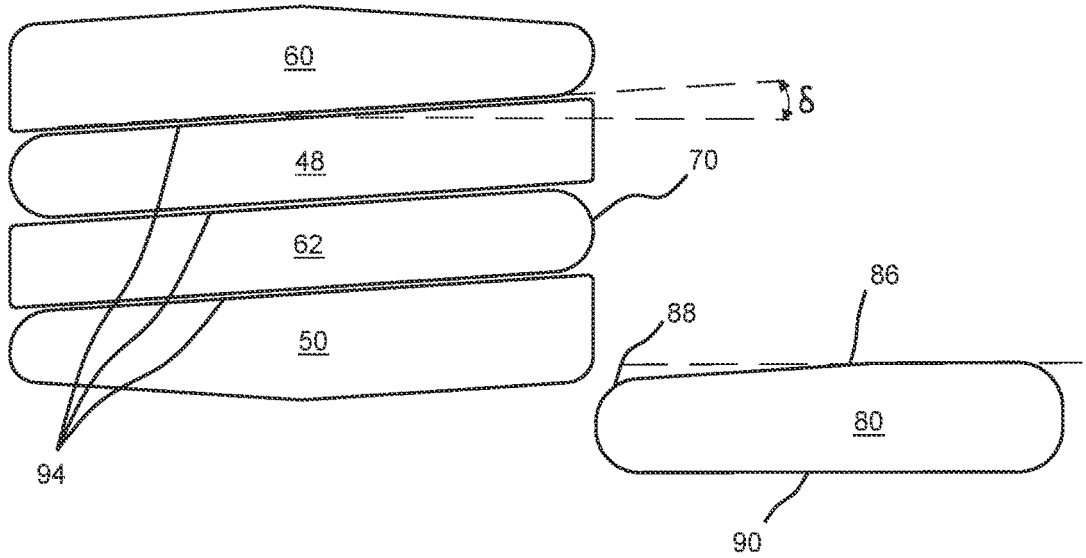
FIG. 9 is a diagrammatic view of one embodiment of a mated thread set as shown in FIG. 7 and FIG. 8 according to the principles of the present disclosure.

Referring to FIG. 9, a diagrammatic view of one embodiment of a mated thread set as shown in FIG. 7 and FIG. 8 according to the principles of the present disclosure. Here, a mated thread set comprises four threads: 60 and 62 and 48 and 50. The mated threads set has a thread incline angle δ and each of the threads 60, 48, 62, and 50 mate along parallel surfaces 94 that are at the same thread incline angle. The stop 80, if present, can have a bottom planar surface 90 and a top surface having an inflection point 86 where angle 88 is defined.

A screw thread is a helical structure used to convert between rotational and linear movement. The mechanical advantage of a screw thread depends on its lead, which is the linear distance the screw travels in one revolution. In most applications, the lead of a screw thread is chosen so that friction is sufficient to prevent linear motion being converted to rotational (i.e., the screw does not slip). In contrast, the present disclosure teaches threads, which are actually small segments (protrusions) having a shared thread incline angle. The present disclosure has a mechanical advantage in that the segments having a thread incline angle act like a wedge to create a clamping force and requiring very little rotational movement.

One embodiment of the press and turn fastener of the present disclosure can be applied in the form of bottle caps or mechanical fasteners, or even for a light bulb where the bulb is inserted into the slots in the lamp socket and tightened into place with one short, partial turn. And in these alternate applications, a positioner/stop might not be required. When used as mechanical fasteners, the screw would be the male end, and the retainer nut the female end. According to the diameter size of the application, the arrayed thread sets and slots could be more or less than four each. As an example: with a large diameter use there could be five threads sets with five slots. A smaller diameter use could have three sets of threads and three slots, or even two sets of threads and two slots. Also, depending on the application and for increased clamping force, there could be more than two layers of threads; three or four, for instance. Or, with an application requiring less clamping force, it might be sufficient to have only one layer of threads.

In the example shown in FIGS. 4 and 6, from a bottom perspective view of the bottle cap and a top perspective view of the bottle top, there are four sets of two threads equally arrayed around the inside surface of the bottle cap and the outside surface of the bottle top. These threads have the same thread incline angle. They also have an equal arc length determined by a 45° sector angle. In-between each arrayed set of two threads there is an open space (slot), also arrayed around the inside surface of the bottle cap and the outside surface of the bottle top. The open space (slot) also has an equal arc length determined by a 45° sector angle. If present, the one or more stops may be located in the open space (slot). In some cases, there may be a stop per slot, or less.

Figure 10:
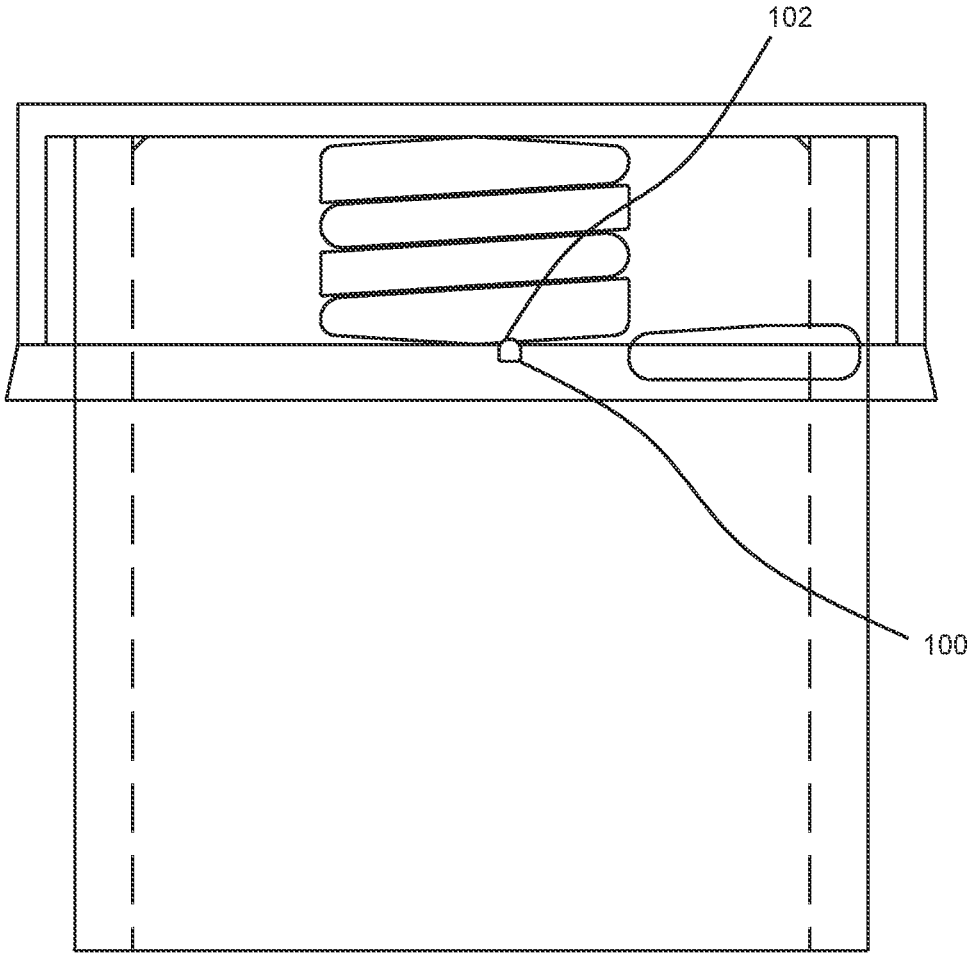
FIG. 10 is a side view of another embodiment of a female portion and a mating male portion of a press and turn fastener in a third position (similar to FIG. 3B) having a lock feature according to the principles of the present disclosure.

Referring to FIG. 10, a side view of another embodiment of a female portion and a mating male portion of a press and turn fastener in a third position (similar to FIG. 3B) having a lock feature according to the principles of the present disclosure is shown. More specifically, according to the principles of the present disclosure of a press and turn fastener, there are instances where a "locking feature" would be implemented into the design of the fastener to prevent it from loosening. This locking feature could comprise a small dimple 102 on the bottom of the lowest (beveled) thread of the female fastener and a small protruded nub 100 located on the male fastener where the dimple would "click" into place over the nub when the press and turn fastener was rotated/tightened into position. This is one version of a locking feature for preventing a press and turn fastener from unscrewing.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A press and turn fastener, comprising:

a female portion having an internal boundary and at least one female thread set;

a male portion having an external boundary configured to mate with the female internal boundary and at least one male thread set; and a locking feature consisting of two interacting components, with at least one of the two interacting components on a lowest beveled thread of the female thread set;

wherein when the at least one female thread set is rotated a fraction of a turn it mates with the at least one male thread set to create at least one mated thread set;

wherein the at least one mated thread set comprises at least two threads consisting of a first thread from the at least one female thread set and a second thread from the at least one male thread set; and wherein the first thread and the second thread together form two halves of the at least one mated thread set.

2. The press and turn fastener according to claim 1, wherein the fraction of a turn is less than 45°.

3. The press and turn fastener according to claim 1, wherein the fraction of a turn is greater than 30°.

4. The press and turn fastener according to claim 1, wherein the fraction of a turn is about 90°.

5. The press and turn fastener according to claim 1, further comprising at least one stop having a first rounded end.

6. The press and turn fastener according to claim 1, wherein the fastener comprises two or more mated thread sets.

7. The press and turn fastener according to claim 1, further comprising a thread incline angle $\delta$ for the mated thread set.

8. The press and turn fastener according to claim 7, wherein the thread incline angle prevents back threading.

9. The press and turn fastener according to claim 1, wherein when the two halves of the at least one mated thread set are rotated clockwise to fasten, the leading edges of each half of the mated thread set are rounded to facilitate mating and fastening.

10. The press and turn fastener according to claim 1, wherein when the two halves of the at least one mated thread set are rotated clockwise to fasten, the trailing edges of each half of the mated thread set are blunted to prevent back threading and to provide greater surface area to contact for sliding and removal from slots.

11. The press and turn fastener according to claim 1, wherein any outer most threads of the mating thread set have a varied width and a point of inflection where a leading bevel ends.

12. The press and turn fastener according to claim 11, wherein an extent of the leading bevel is represented by the angle $\alpha$ or angle $\beta$.

13. The press and turn fastener according to claim 5, wherein the stop having a second rounded end being opposite the first rounded end.

14. The press and turn fastener according to claim 1, wherein the at least one of the two interacting components of the locking feature comprises a small dimple on a bottom of the lowest beveled thread of the female thread set; and the locking feature further comprising at least a second interacting component protruding from the male fastener capable of interacting with the at least one of the two interacting components of the locking feature.

15. A press and turn fastener, comprising:

a lid portion having:

an internal boundary;

a first lid thread set with at least a first lid thread;

a second lid thread set with at least a second lid thread; and a lid slot vertically extending between, and thereby horizontally separating, the first lid thread set and the second lid thread set; and a container portion having:

an external boundary configured to interact with the internal boundary of the container portion;

a first container thread set with at least a first container thread;

a second container thread set with at least a second container thread;

a container slot vertically extending between, and thereby horizontally separating, the first container thread set and the second container thread set; and at least one stop, horizontally positioned fully within the container slot, having a first rounded end and a second rounded end being opposite the first rounded end.

16. A press and turn fastener, comprising:

a female portion having an internal boundary, a first outermost edge, a first outermost thread adjacent the first outermost edge, and at least a first inner thread being displaced from the first outermost edge;

a male portion having an external boundary, configured to mate with the female internal boundary, the male portion further having a second outermost edge, a second outermost thread adjacent the second outermost edge, and at least a second inner thread being displaced from the second outermost edge;

at least one mated thread set being formed when the first outermost thread is rotated clockwise a fraction of a turn to mate with the second outermost thread; and a leading edge of each of the first and the second outermost threads having a varied width and a point of inflection where a leading bevel ends;

wherein the leading bevel of the first and second outermost threads being nonparallel to surfaces of each of the first and second inner threads, and an extent of the leading bevel having a bevel angle being greater than a thread incline angle.

* * * * *